US011061347B2

(12) United States Patent
Kanno et al.

(10) Patent No.: US 11,061,347 B2
(45) Date of Patent: Jul. 13, 2021

(54) PRINTER HAVING POWDER DETECTION AND SUPPLY CONVEYOR CONTROL

(71) Applicant: FUJIFILM Business Innovation Corp., Tokyo (JP)

(72) Inventors: Makoto Kanno, Kanagawa (JP); Ryo Fukuno, Kanagawa (JP); Tomoyuki Hamachi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/799,142

(22) Filed: Feb. 24, 2020

(65) Prior Publication Data

US 2021/0088937 A1 Mar. 25, 2021

(30) Foreign Application Priority Data

Sep. 20, 2019 (JP) ..... JP2019-170966

(51) Int. Cl.
*G03G 15/08* (2006.01)

(52) U.S. Cl.
CPC ..... *G03G 15/0891* (2013.01); *G03G 15/0856* (2013.01)

(58) Field of Classification Search
USPC ..... 399/61
See application file for complete search history.

(56) References Cited

U.S. PATENT DOCUMENTS

| | | | | |
|---|---|---|---|---|
| 6,970,657 | B2 * | 11/2005 | Suenaga | G03G 15/0856 399/254 |
| 2007/0098449 | A1 * | 5/2007 | Kadota | G03G 15/0877 399/254 |
| 2008/0253809 | A1 * | 10/2008 | Aimoto | G03G 15/0893 399/254 |
| 2008/0285985 | A1 * | 11/2008 | Park | G03G 15/0808 399/27 |
| 2009/0310984 | A1 * | 12/2009 | Sakatani | G03G 15/0893 399/30 |
| 2010/0158573 | A1 * | 6/2010 | Sheen | G03G 15/0856 399/254 |
| 2018/0017892 | A1 * | 1/2018 | Shigehiro | G03G 15/0851 |

FOREIGN PATENT DOCUMENTS

| | | |
|---|---|---|
| JP | 4-037774 A | 2/1992 |
| JP | 2012-163628 A | 8/2012 |

* cited by examiner

*Primary Examiner* — Q Grainger
(74) *Attorney, Agent, or Firm* — Sughrue Mion, PLLC

(57) ABSTRACT

A printer including: a powder housing chamber that houses powder including a color material and carrier; a supplying conveying unit that conveys the powder while supplying the powder to a powder holder that holds the powder, by forward rotation; a detection unit that detects the amount of powder within the powder housing chamber, upstream in a conveyance direction from a discharge unit that discharges surplus powder, downstream in the conveyance direction from the supplying conveying unit, and above a rotary shaft of the supplying conveying unit; and a control unit that controls at least one of the rotation direction and the rotation speed of the supplying conveying unit on the basis of a detection result of the detection unit.

16 Claims, 14 Drawing Sheets

PRINTER HAVING POWDER DETECTION AND SUPPLY CONVEYOR CONTROL

CROSS-REFERENCE TO RELATED APPLICATIONS

This application is based on and claims priority under 35 USC 119 from Japanese Patent Application No. 2019-170966 filed Sep. 20, 2019.

BACKGROUND

(i) Technical Field

The present disclosure relates to a printer.

(ii) Related Art

There is a known color image forming device in which developing devices are arranged in parallel below a photoconductor belt. The developing devices are each provided with: a developing roller that has a magnetic roller inside a rotating sleeve; and a developer housing box in which the space below the developing roller is divided into a developer adhering chamber and a developer replenishing chamber by a developer scraping plate, and developer is circulated between both chambers by stirring screws. The color image forming device is configured such that a non-magnetic region is formed on the surface, of the magnetic roller, that opposes the developer replenishing chamber side, a developer discharge port is provided at the starting end of the developer replenishing chamber, and the stirring screws can be reverse-rotated when the developer is discharged (Japanese Unexamined Patent Application Publication No. 4-37774).

There is also a known image forming device which has: an image carrier that forms an electrostatic latent image; a developing device provided with a developer container that houses two-component developer including toner and carrier, a developer carrier that carries and conveys the two-component developer and converts the electrostatic latent image into a toner image, a developer conveying unit that is provided in the developer container and conveys and circulates the two-component developer housed in the developer container, and a discharge port that is provided in the developer container and discharges the two-component developer housed in the developer container; a detection unit that detects information relating to the amount of consumed toner of an image that is output; and a replenishing unit that replenishes the developer container with developer on the basis of the information relating to the amount of consumed toner. The image forming device has a control unit that performs control such that, when the amount of consumed toner for one or more sheets detected by the detection unit exceeds a predetermined threshold value, the conveying speed of the developer conveying unit increases compared to when the amount of consumed toner does not exceed the predetermined threshold value (Japanese Unexamined Patent Application Publication No. 2012-163628).

SUMMARY

Aspects of non-limiting embodiments of the present disclosure relate to stabilizing the amount of powder including a color material and carrier in a powder supply device having a powder discharge mechanism, without causing a decline in image forming productivity, compared to when the amount of powder including a color material and carrier is stabilized using predictive detection.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a printer including: a powder housing chamber that houses powder including a color material and carrier; a supplying conveying unit that conveys the powder while supplying the powder to a powder holder that holds the powder, by forward rotation; a detection unit that detects the amount of powder within the powder housing chamber, upstream in a conveyance direction from a discharge unit that discharges surplus powder, downstream in the conveyance direction from the supplying conveying unit, and above a rotary shaft of the supplying conveying unit; and a control unit that controls at least one of the rotation direction and the rotation speed of the supplying conveying unit on the basis of a detection result of the detection unit.

BRIEF DESCRIPTION OF THE DRAWINGS

Exemplary embodiments of the present disclosure will be described in detail based on the following figures, wherein.

DETAILED DESCRIPTION

Next, the present disclosure will be described in further detail with exemplary embodiments and specific examples being given hereinafter with reference to the drawings; however, the present disclosure is not restricted to these exemplary embodiments and specific examples.

Furthermore, in the description using the drawings hereinafter, please be aware that the drawings are schematic and the ratios of the dimensions and so forth are different from those in reality, and members other than those required for the description are not depicted as appropriate to aid understanding.

Figure 1:
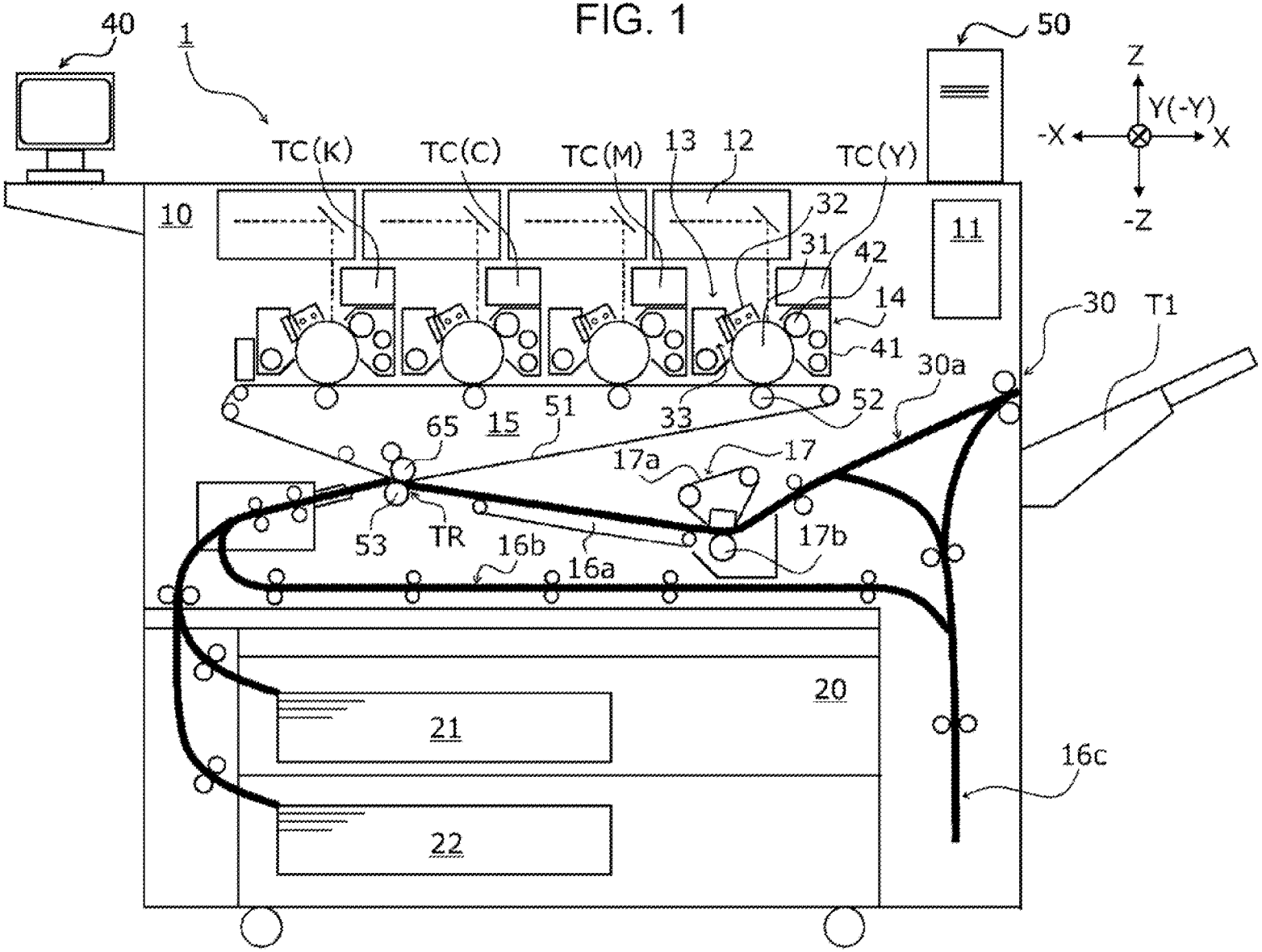
FIG. 1 is a cross-sectional schematic view depicting an example of a schematic configuration of an image forming device.

Exemplary Embodiment (1) Overall Configuration and Operation of Image Forming Device (1.1) Overall Configuration of Image Forming Device FIG. 1 is a cross-sectional schematic view depicting an example of a schematic configuration of an image forming device 1 according to the present exemplary embodiment.

The image forming device 1 is provided with: an image forming unit 10; a paper feeding device 20 mounted below the image forming unit 10; a paper output unit 30 mounted at one end of the image forming unit 10 and from which printed paper is output; an operation display unit 40; and an image processing unit 50 that generates image information from printing information transmitted from a higher-level device. Furthermore, the image forming device 1 is an example of a printer, and may be constituted by another device. For example, a powder coating device may constitute an example of a printer by using the developer in the exemplary embodiments as a coating powder. Specifically, the developing device 14 in the exemplary embodiments is used as a powder coating head (an example of a powder supply device) in an electrostatic powder coating method, and a conductive sheet-like medium is conveyed close to this powder coating head. By applying a bias voltage between the powder coating head and the conductive sheet-like medium, charged coating powder (for example, thermosetting toner) is coated onto the sheet-like medium. Thereafter, if the sheet-like medium is heated, the surface of the sheet-like medium is coated.

The image forming unit 10 is provided with a system control device 11, exposure devices 12, photoconductor units 13, developing devices 14, a transfer device 15, paper conveying devices 16*a*, 16*b*, and 16*c*, and a fixing device 17, and forms toner images on a recording medium that is fed from the paper feeding device 20.

The paper feeding device 20 supplies the recording medium to the image forming unit 10. In other words, the paper feeding device 20 is provided with multiple paper loading units 21 and 22 that house recording mediums of different types (materials, thicknesses, paper sizes, and grain directions, for example), and is configured to supply the image forming unit 10 with a recording medium fed from any one of the multiple paper loading units 21 and 22.

The paper output unit 30 outputs images in the image forming unit 10, and outputs paper P to which images have been fixed by the fixing device 17. Therefore, the paper output unit 30 is provided with a transport path 30*a* along which the paper P is conveyed after fixing, and an output paper housing unit T1 onto which the paper P is output. Furthermore, there is provided a paper reversing unit 18 that, in a case where images are to be output to both sides of the paper P, reverses the front and rear of the paper P and feeds the paper P to the paper conveying device 16*b*. It should be noted that the paper output unit 30 may have a function of carrying out post-processing such as cutting and stapling (needle binding) with respect to a paper bundle that is output from the image forming unit 10.

The operation display unit 40 is used for inputting various types of settings and instructions and for displaying information. In other words, the operation display unit 40 corresponds to a user interface so to speak, and, to be specific, is configured by combining a liquid crystal display panel, various types of operation buttons, a touch panel, or the like.

(1.2) Configuration and Operation of Image Forming Unit

In the image forming device 1 having this kind of configuration, a recording medium that is fed from the paper loading unit 21 or 22 designated for each sheet of printing in a print job from among the paper loading units 21 and 22 is conveyed to the image forming unit 10 in accordance with the timing of image forming.

The photoconductor units 13 are respectively provided in parallel below the exposure devices 12, and are provided with photoconductor drums 31 serving as rotationally driven latent image holders. A charger 32, an exposure device 12, a developing device 14, a first transfer roller 52, and a cleaning device 33 are arranged in the rotation direction of each photoconductor drum 31.

In the developing devices 14 (an example of a powder supply device), developing rollers 42 serving as developer holders are arranged opposing the photoconductor drums 31. The developing devices 14 are configured in substantially the same manner except for the developer, and form toner images of yellow (Y), magenta (M), cyan (C), and black (B) on the photoconductor drums 31 using the respective developing rollers 42.

Exchangeable toner cartridges TC that house toner and toner supply devices (not depicted) that supply toner and carrier from the respective toner cartridges TC to the developing devices 14 are arranged above the developing devices 14. Furthermore, toner is an example of a color material, and developer is an example of powder including a color material and carrier.

The surfaces of the rotating photoconductor drums 31 are charged by the chargers 32, and electrostatic latent images are formed by latent image-forming light emitted from the exposure devices 12. The electrostatic latent images formed on the photoconductor drums 31 are developed as toner images by the developing rollers 42.

The transfer device 15 is provided with: an intermediate transfer belt 51 that carries out multiple transfer of color toner images formed by the photoconductor drums 31 of the photoconductor units 13; first transfer rollers 52 that sequentially transfer the color toner images formed by the photoconductor units 13 to the intermediate transfer belt 51 (first transfer); and a second transfer roller 53 that carries out batch transfer of the color toner images superposed and transferred on the intermediate transfer belt 51 to the paper P, which is a recording medium (second transfer).

The color toner images formed on the photoconductor drums 31 of the photoconductor units 13 are sequentially electrostatically transferred (first transfer) onto the intermediate transfer belt 51 by the first transfer rollers 52 to which a predetermined transfer voltage is applied from a power source device or the like (not depicted) controlled by the system control device 11, and superposed toner images in which the toner images are superposed are formed.

The superposed toner images on the intermediate transfer belt 51 are conveyed to a second transfer part TR due to the movement of the intermediate transfer belt 51. The second transfer part TR includes the second transfer roller 53 arranged pressed against a backup roller 65 with the intermediate transfer belt 51 interposed.

The paper P is supplied to the second transfer part TR from the paper feeding device 20 in accordance with the timing at which the superposed toner images are conveyed to the second transfer part TR. A predetermined second transfer voltage is then applied from a power source device (not depicted) controlled by the system control device 11 to the backup roller 65 that opposes the second transfer roller 53 with the intermediate transfer belt 51 interposed, and the superposed toner images on the intermediate transfer belt 51 are batch-transferred onto the paper P.

Residual toner on the surfaces of the photoconductor drums 31 is removed by the cleaning devices 33 and recovered to a waste toner housing unit (not depicted). The surfaces of the photoconductor drums 31 are recharged by the chargers 32.

The fixing device 17 has an endless fixing belt 17*a* that rotates in one direction and a pressure roller 17*b* that comes into contact with the peripheral surface of the fixing belt 17*a* and rotates in one direction, and a nip part (fixing region) is formed by a pressure contact region between the fixing belt 17*a* and the pressure roller 17*b*.

The paper P on which the toner images have been transferred in the transfer device 15 is conveyed to the fixing device 17 via the paper conveying device 16*a* with the toner images in a non-fixed state. The toner images are fixed to the paper P conveyed to the fixing device 17, by the pair of the fixing belt 17*a* and the pressure roller 17*b* due to a heating and pressure-attaching action.

The paper P for which fixing has ended is loaded onto the output paper housing unit T1. It should be noted that in a case where images are to be output to both sides of the paper P, the front and rear of the paper P are reversed by the paper conveying device 16*c*, and the paper P is once again fed to the second transfer part TR in the image forming unit 10 via the paper conveying device 16*b*. Then, after toner images are transferred and the transferred images are fixed, the paper P is fed to the paper output unit 30. The paper P that is fed to the paper output unit 30 is subjected to post-processing such as cutting and stapling (needle binding) as necessary.

(2) Configuration of Main Parts

Figure 2:
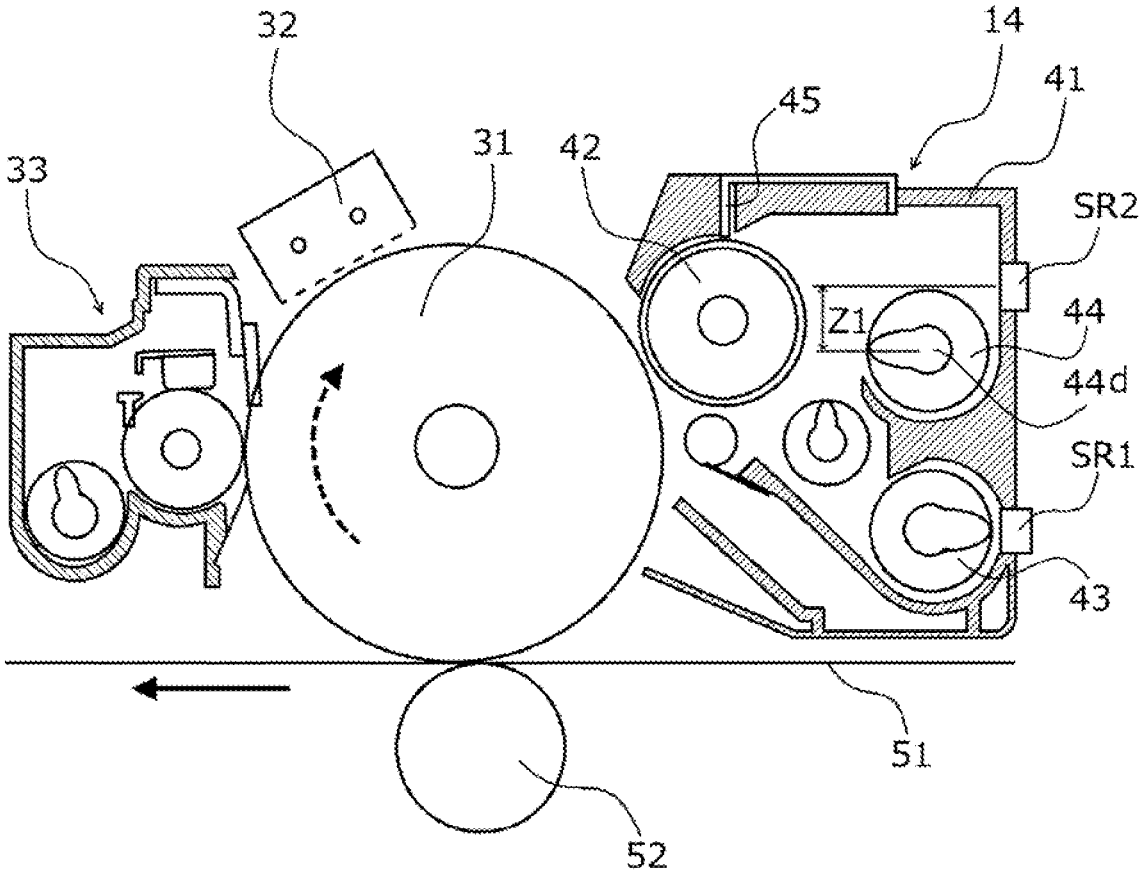
FIG. 2 is a longitudinal cross-sectional schematic view depicting a photoconductor unit and a developing device.
Figure 3:
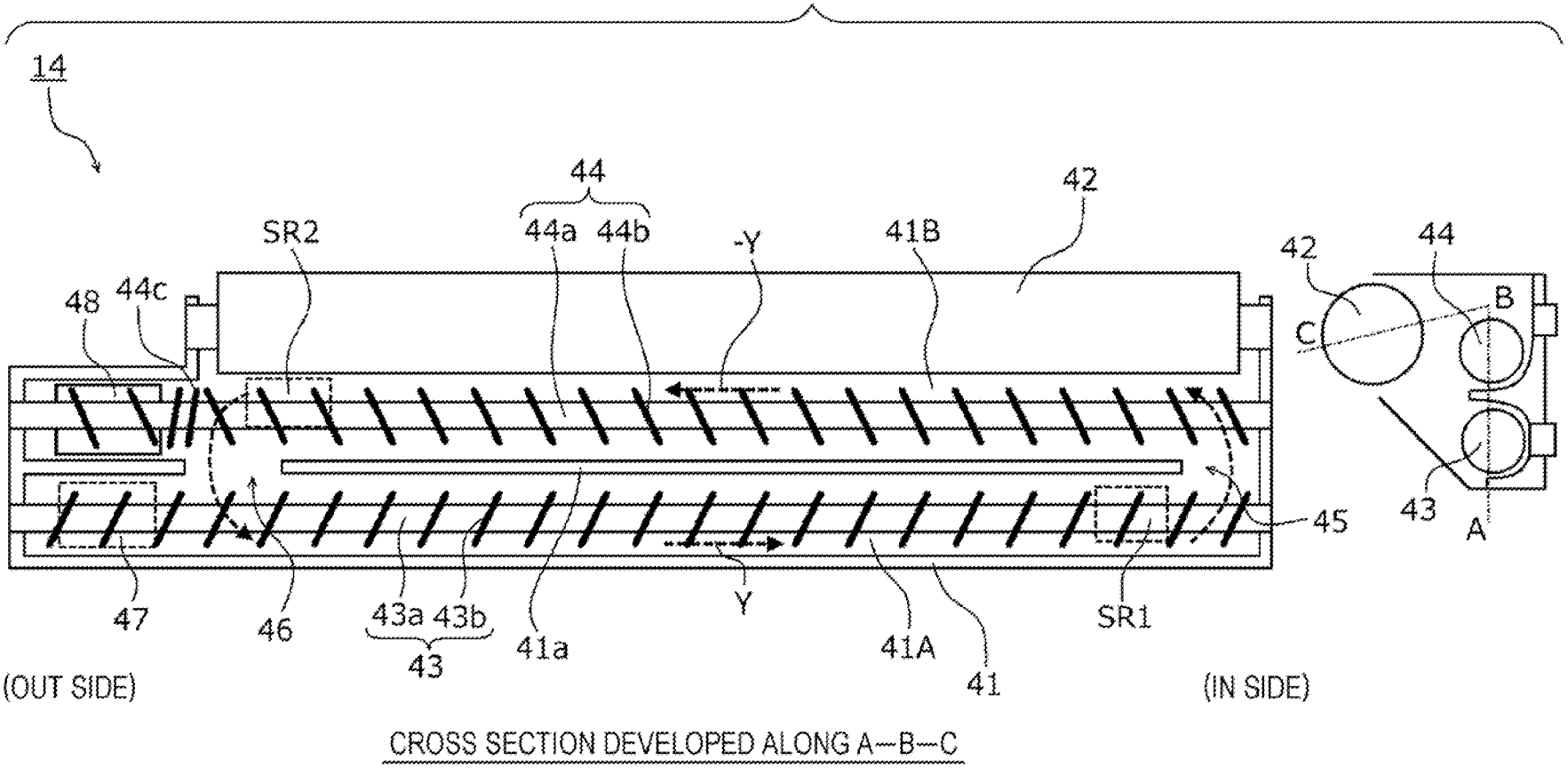
FIG. 3 is a cross-sectional schematic view developed in the horizontal direction along line A-B-C line in FIG. 2, illustrating the conveying of developer inside the developing device.

FIG. 2 is a cross-sectional schematic view depicting a photoconductor unit 13 and a developing device 14, and FIG. 3 is a cross-sectional schematic view developed in the horizontal direction along line A-B-C line in FIG. 2, illustrating the conveying of developer inside the developing device 14.

Hereinafter, a configuration and operation of the developing device 14 will be described with reference to the drawings.

(2.1) Overall Configuration of Developing Device

The developing device 14 is provided with a developing housing 41 that houses developer including toner and carrier, a developing roller 42 arranged opposing a photoconductor drum 31, a stirring auger 43 that conveys the developer while stirring the developer, and a supply auger 44 serving as an example of a supplying conveying unit that supplies the developer to the developing roller 42.

The developing roller 42 has a magnet therein and rotates with developer being adsorbed on the surface thereof due to a magnetic force, and thereby feeds the developer from the developing housing 41 to a developing location opposing the photoconductor drum 31. An electrostatic latent image formed on the surface of the photoconductor drum 31 is developed at the developing location, and the developer after developing is returned to the developing housing 41 by the rotation of the developing roller 42.

(2.2) Circulation of Developer

FIG. 3 is a cross-sectional schematic view developed in the horizontal direction along line A-B-C line in FIG. 2, for illustrating the conveying (movement) of developer inside the developing device 14.

In the developing housing 41, a partition wall 41*a* is provided in an upright manner between the stirring auger 43 and the supply auger 44 such that the developing housing 41 is partitioned into two developer housing parts 41A and 41B, and openings 45 and 46 are formed respectively at both end sections of the partition wall 41*a* in the longitudinal direction.

The stirring auger 43 and the supply auger 44 have spiral blades 43*b* and 44*b* formed therein around rotary shafts 43*a* and 44*a*, receive a rotational force from a drive source (not depicted) and rotate along inner walls inside the developer housing parts 41A and 41B, and thereby convey developer in predetermined directions inside the developer housing parts 41A and 41B.

Specifically, the stirring auger 43 conveys the developer inside the developer housing part 41A in the direction of arrow (Y) while stirring the developer, and the supply auger 44 conveys the developer inside the developer housing part 41B in the direction of arrow (−Y) while stirring the developer. The developer conveyed in the direction of arrow (Y) moves from the opening 45 to the developer housing part 41B, and the developer conveyed in the direction of arrow (−Y) moves from the opening 46 to the developer housing part 41A.

The developer inside the developing housing 41 thereby circulates and moves while being stirred by both the stirring auger 43 and the supply auger 44. The toner within the developer is charged by this kind of stirring of the developer.

A receiving port 47 (schematically depicted in FIG. 3 to illustrate the function thereof) that receives toner and carrier supplied from the toner cartridge TC is provided in an upper surface portion at one end side (−Y direction, front-surface side of the device) of the developing housing 41. The toner received in the developing device 14 by the receiving port 47 is conveyed by the stirring auger 43 and thereby moves to the developer housing part 41A of the developing housing 41 and mixes with the developer.

Toner replenished via the receiving port 47 from the toner cartridge TC is conveyed from the front-surface side (OUT side, −Y direction, hereinafter referred to as the OUT side) to the rear side (IN side, Y direction, hereinafter referred to as the IN side) while being stirred together with carrier by the stirring auger 43, and is moved to the supply auger 44 at the rear side (IN side, Y direction). The toner supplied from the supply auger 44 is then supplied to the developing roller 42.

A toner concentration sensor SR1 that measures the ratio of toner (TC) with respect to carrier of the developer circulating within the developing housing 41 is arranged in the developing device 14. In the image forming device 1, the TC value of the developer is maintained at a predetermined value by the system control device 11 instructing toner to be replenished from the toner cartridge TC on the basis of a measurement value according to the toner concentration sensor SR1.

In the present exemplary embodiment, developer is supplied to the developing roller 42 from the IN side to the OUT side, and therefore there is a decrease in the amount of toner supplied when the developer reaches the OUT side, and therefore the toner concentration sensor SR1 is provided at the IN side of the stirring auger 43 in order to appropriately control the amount of toner supplied.

Furthermore, a discharge port 48 is provided in a side surface portion at one end side (−Y direction, front-surface side of the device) of the developing housing 41. A reverse spiral blade 44*c* that has a reverse spiral direction compared with the spiral blade 44*b* of other sections is provided between the developing housing 41 and the discharge port 48, and therefore the majority of the developer that has been conveyed in the direction of arrow (−Y) in the developer housing part 41B of the developing housing 41 is guided toward the opening 46 by the reverse spiral blade 44*c* and moves toward the developer housing part 41A. However, some of the developer passes over the reverse spiral blade 44*c* and is discharged outside the developing device 14 as surplus developer from the discharge port 48 (schematically depicted in FIG. 3 to illustrate the function thereof).

In order for some of the developer circulating and moving to be stably discharged from the discharge port 48 in this way, a developer amount sensor SR2 serving as an example of a detection unit that detects the amount of developer is provided upstream in the developer conveyance direction from the discharge port 48 in the developer housing part 41B of the developing housing 41. As depicted in FIG. 2, the developer amount sensor SR2 is provided above a rotary shaft 44*d* of the supply auger 44 in the vertical direction (Z direction, see Z1 in the drawing), so as to be able to detect the quantity of developer conveyed by the supply auger 44 within the developer housing part 41B.

(2.3) Controlling the Amount of Developer

Figure 4:
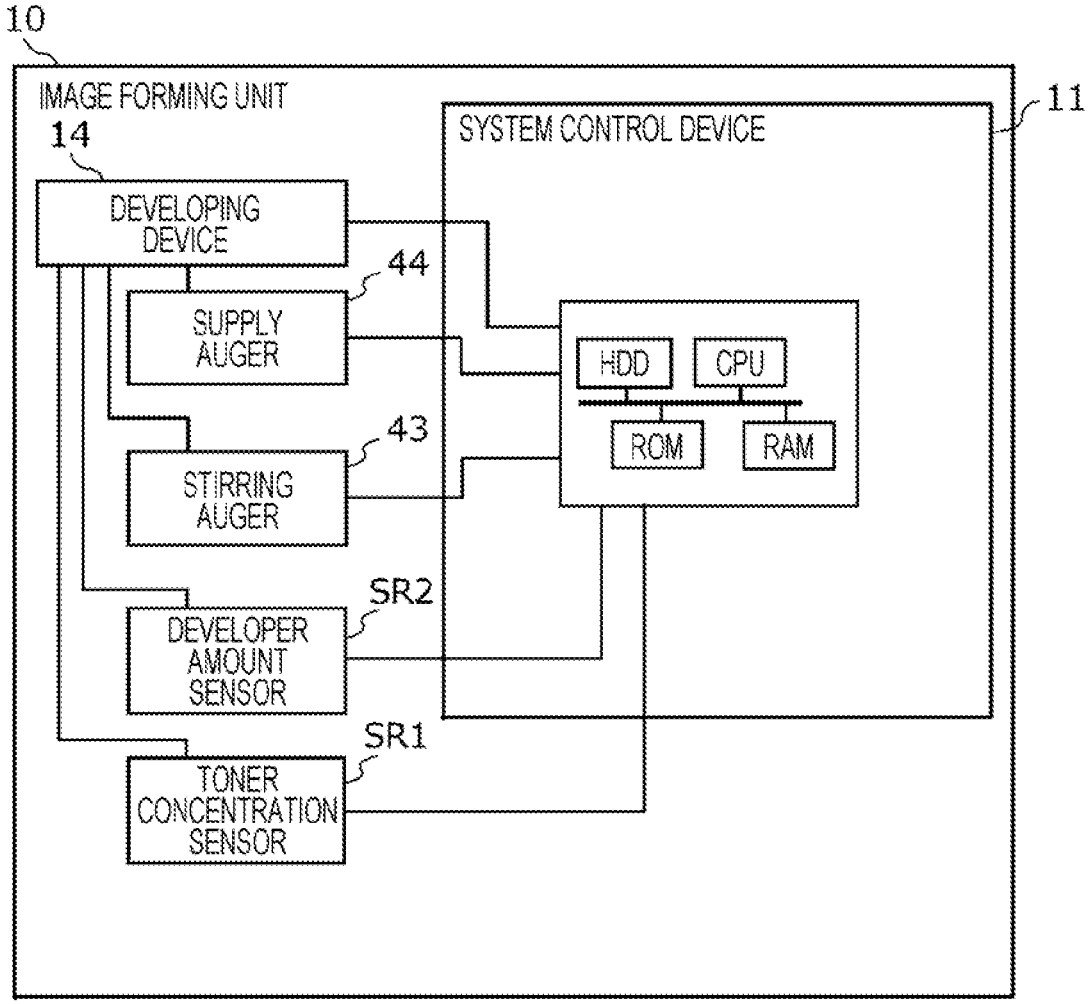
FIG. 4 is a functional block diagram depicting a functional configuration of an image forming unit.
Figure 5:
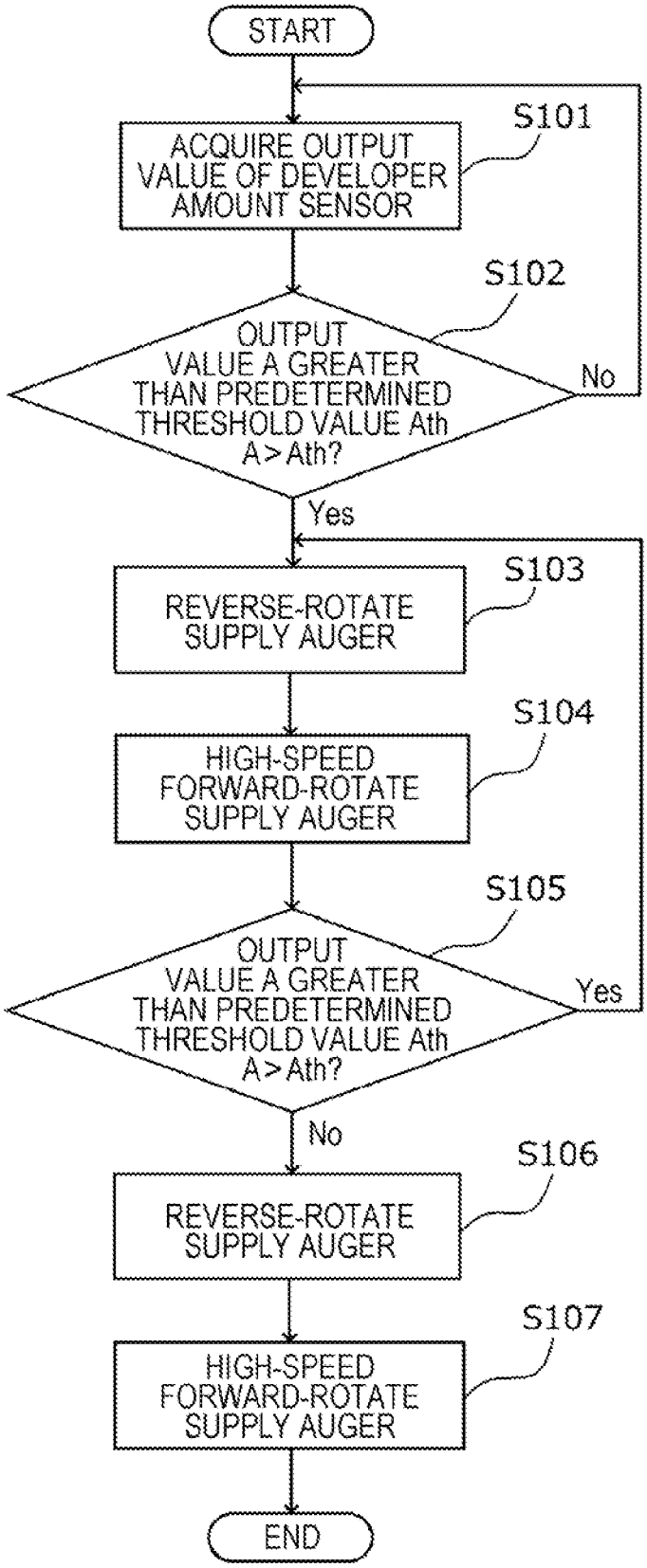
FIG. 5 is a flowchart depicting the flow of an operation of the developing device.
Figure 13:
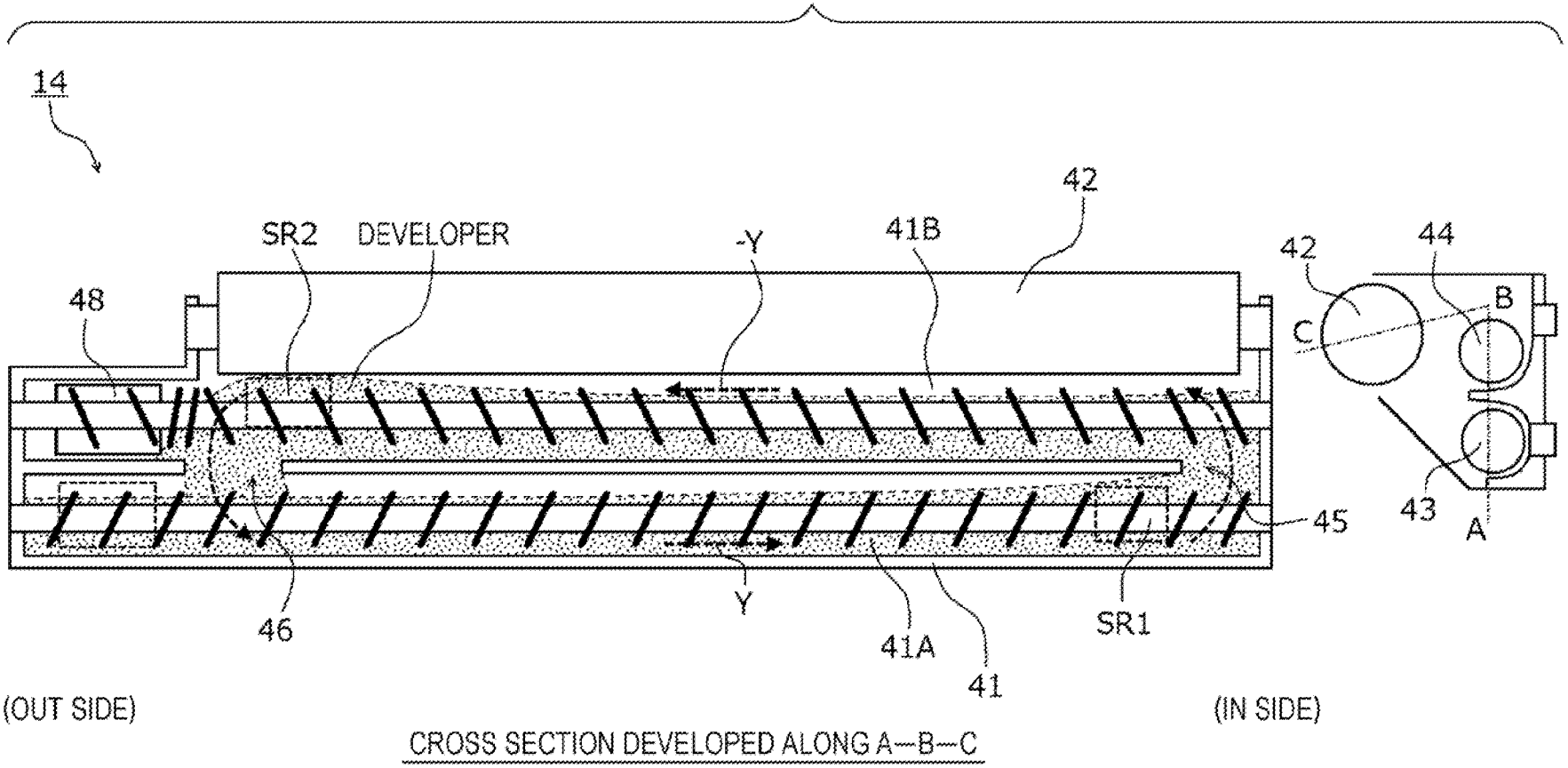
FIG. 13 is a cross-sectional schematic view for illustrating the circulation state of developer inside the developing device.
Figure 14:
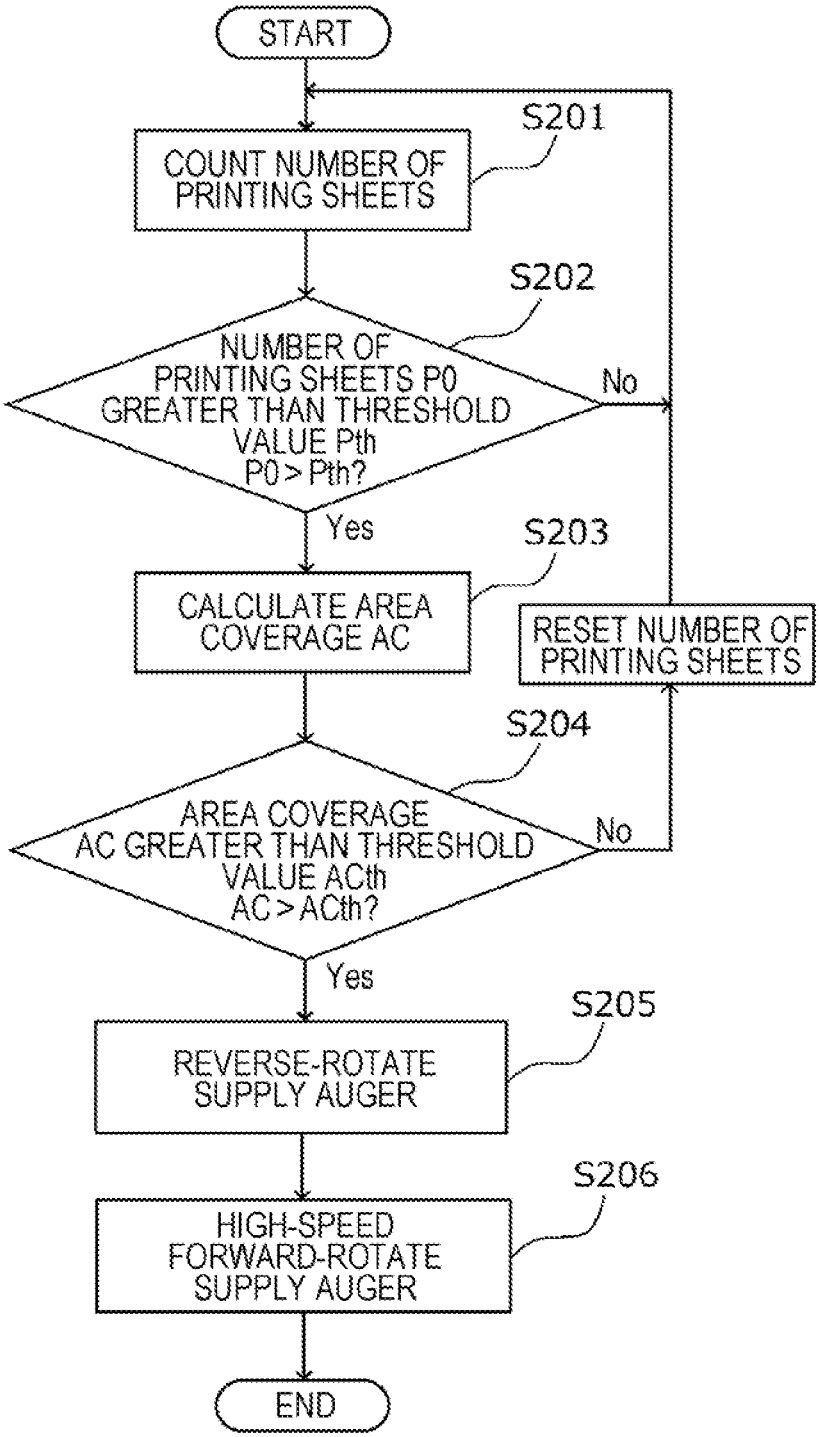
FIG. 14 is a flowchart depicting the flow of an operation to control the amount of developer in an image forming device of a comparative example.

FIG. 4 is a functional block diagram depicting a functional configuration of the image forming unit 10, FIG. 5 is a flowchart depicting the flow of an operation of the developing device 14, FIG. 13 is a cross-sectional schematic view for illustrating the circulation state of developer inside the developing device 14, and FIG. 14 is a flowchart depicting the flow of an operation to control the amount of developer in an image forming device 100 of a comparative example.

As depicted in FIG. 13, within the developer housing part 41A of the developing device 14, due to the stirring auger 43, developer (depicted by halftone dots) is stirred and mixed with toner and carrier replenished from the toner cartridge TC and is conveyed from the OUT side to the IN side with a predetermined powder level being maintained. Within the developer housing part 41B of the developing device 14, the developer, which flows in so as to rise from the opening 45, is conveyed from the IN side to the OUT side with the predetermined powder level being maintained while being stirred by the supply auger 44.

In this state, the toner within the developer is consumed due to image forming whereas the carrier is not consumed and is therefore stirred for a long time within the developing housing 41, and an external additive of the toner or the toner may adhere to the carrier surface and so-called developer deterioration may occur. As a result, there is a risk of it not being possible for the toner charge amount to be maintained at an appropriate value due to a decline in the charge imparting ability of the carrier with respect to the toner.

Also, in a configuration in which surplus developer within the developing housing 41 is discharged outside the developing device 14 from the discharge port 48, if developer deterioration occurs the fluidity of the developer decreases, the discharge of developer from the discharge port 48 is insufficient, and there is a risk of the problem of considerable fluctuation in the amount of developer within the developing housing.

In the image forming device 100 according to the comparative example, poor discharge of deteriorated developer is suppressed due to the flow of the operation depicted in the flowchart of FIG. 14.

The image forming device 100 of the comparative example, which is not provided with the developer amount sensor SR2 that detects the amount of developer within the developing housing 41, counts the number of printing sheets (S201), and, in a case where the number of printing sheets P0 exceeds a threshold value Pth that serves as a predetermined number of printing sheets (S202: yes), measures the total image pixels of the print job via the image processing unit 50 and calculates the area coverage AC of the print job (S203).

In a case where the area coverage AC is higher than a predetermined threshold value ACth (S204: yes), the supply auger 44 is reverse-rotated for a predetermined time (S205), and then the supply auger 44 is forward-rotated for a predetermined time for a number of rotations faster than normal (S206).

Thus, poor discharge of deteriorated developer is expected to be limited; however, due to control to temporarily reverse-rotate and then forward-rotate the supply auger 44 based on a prediction on the basis of the number of printing sheets P0 and the area coverage AC regardless of the amount of developer within the developing housing 41, there has been a problem in that fluctuation in the amount of developer cannot be accurately suppressed. Furthermore, since the supply auger 44 is reverse-rotated and forward-rotated for a predetermined time based on a prediction, there has also been a problem in that there is a decline in the productivity of the image forming performed by the image forming device 100.

The image forming device 1 according to the present exemplary embodiment is provided with the developer amount sensor SR2 that detects the amount of developer within the developing housing 41, upstream in the conveyance direction from the discharge port 48 that discharges surplus developer, downstream in the conveyance direction of the developer brought about by the supply auger 44, and above the rotary shaft 44*d* of the supply auger 44. As depicted in the functional block diagram of FIG. 4, the system control device 11, which serves as an example of a control unit, controls at least one of the rotation direction and the rotation speed of the supply auger 44 on the basis of a detection result of the developer amount sensor SR2.

In the present exemplary embodiment, a magnetic permeability sensor may be used as the developer amount sensor SR2. A magnetic permeability sensor detects the magnetic permeability of two-component developer composed of toner and carrier within the developing housing 41. It is also possible for the powder level of the developer to be detected on the basis of the output value of a magnetic permeability sensor.

As indicated in the flowchart of FIG. 5, the image forming device 1 acquires an output value A of the developer amount sensor SR2 (S101), and determines whether or not the output value A is greater than a predetermined threshold value Ath (S102). In a case where the output value A is greater than the threshold value Ath (S102: yes), the supply auger 44 is reverse-rotated for a predetermined number of rotations N1

(S103), and then the supply auger 44 is forward-rotated for a predetermined number of rotations N2 at a faster rotation speed than normal (S104).

Also, in a case where it is determined whether or not the output value A of the developer amount sensor SR2 is greater than the threshold value Ath (S105) and the output value A is smaller than the threshold value Ath (S105: no), the supply auger 44 is reverse-rotated for the predetermined number of rotations N1 (S106), the supply auger 44 is then forward-rotated for the predetermined number of rotations N2 at a faster rotation speed than normal (S107), and is then forward-rotated at the normal rotation speed.

Thus, the powder level of the developer in the developer housing part 41B of the developing housing 41 can be reliably detected and the amount of developer can be stabilized. Furthermore, a decline in image forming productivity can be suppressed by carrying out rotation control (reverse rotation and high-speed forward rotation) for the supply auger 44 only in a case where the powder level of the developer in the developer housing part 41B is detected and the powder level is higher than a predetermined height.

Modified Example 1

Figure 6:
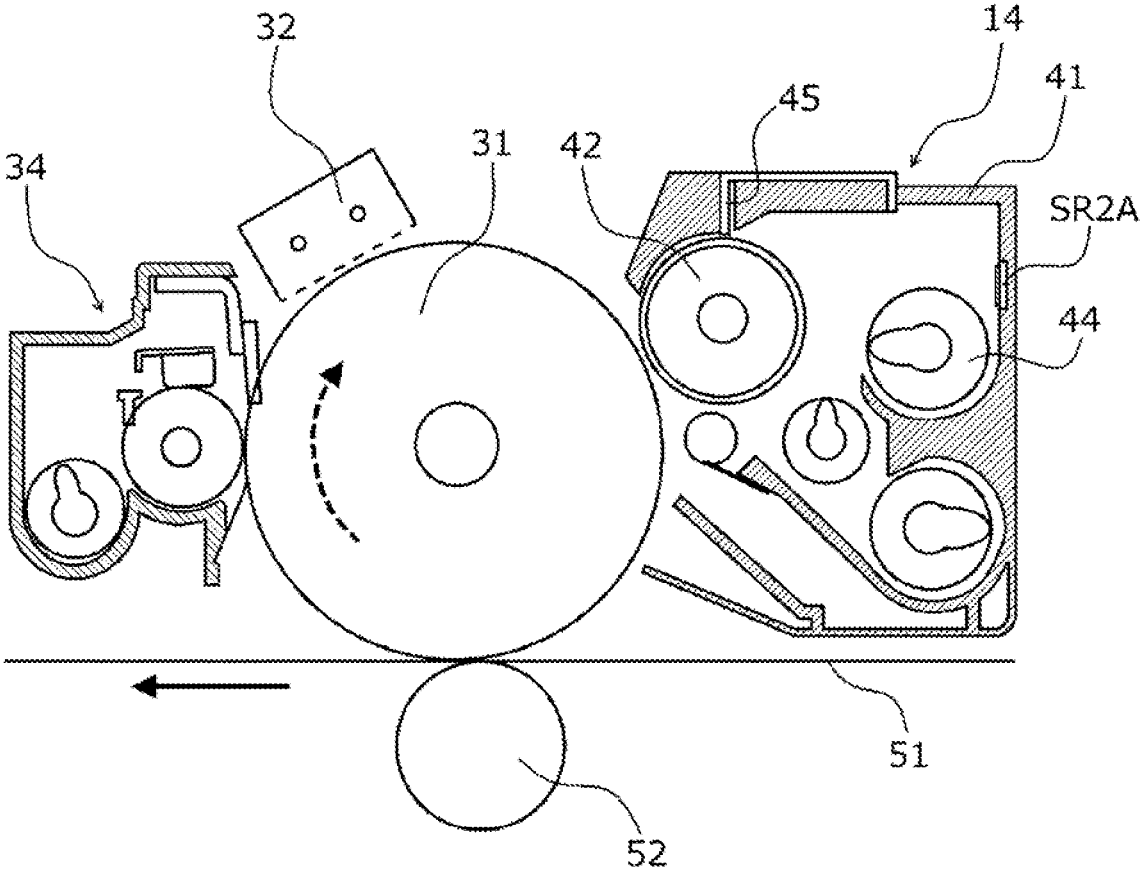
FIG. 6 is a cross-sectional schematic view of a developing device to which a developer amount sensor according to modified example 1 is attached.
Figure 7A:
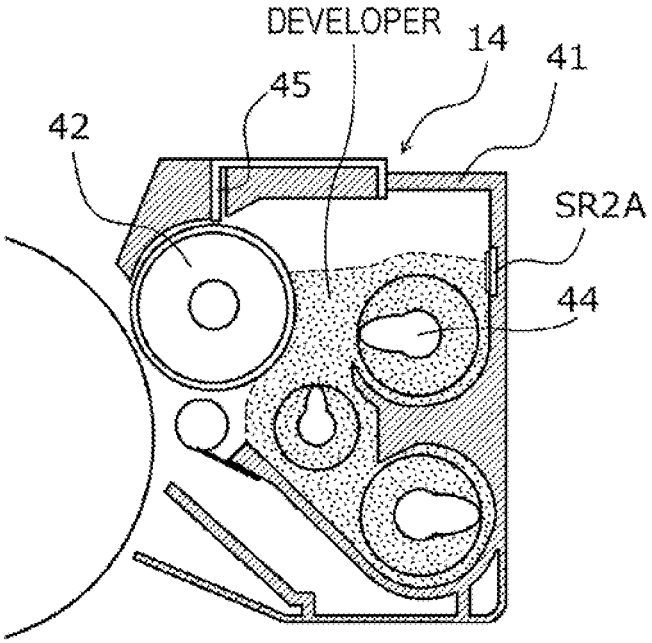
FIGS. 7A and 7B are cross-sectional schematic views of the developing device illustrating the detection of an amount of developer by the developer amount sensor according to modified example 1.
Figure 7B:
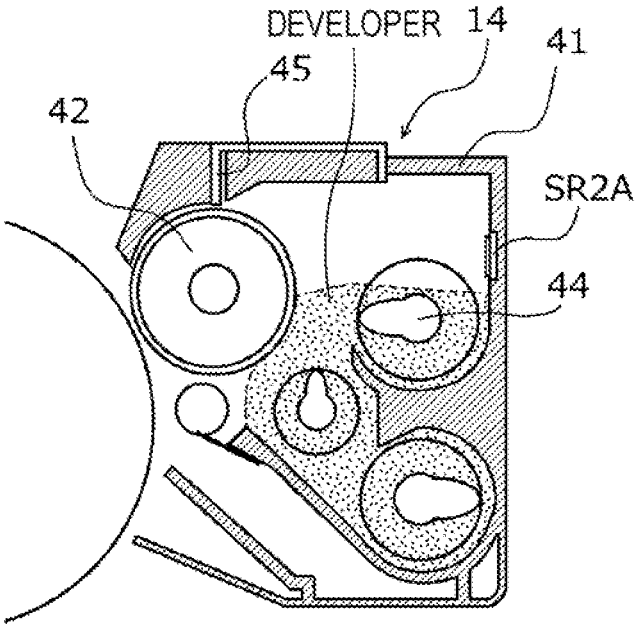

FIG. 6 is a cross-sectional schematic view of the developing device 14 to which a developer amount sensor SR2A according to modified example 1 is attached, and FIGS. 7A and 7B are cross-sectional schematic views of the developing device 14 illustrating the detection of an amount of developer by the developer amount sensor SR2A. As depicted in FIG. 6, the developer amount sensor SR2A may be a sensor having a piezo element.

As depicted in FIG. 7A, when there is developer on the piezo element of the developer amount sensor SR2A, the system control device 11 determines that the amount of developer housed within the developer housing part 41B of the developing housing 41 is greater than or equal to a predetermined value, causes the supply auger 44 to reverse-rotate for the predetermined number of rotations N1 (S103), and then causes the supply auger 44 to forward-rotate for the predetermined number of rotations N2 at a faster rotation speed than normal (S104).

Meanwhile, as depicted in FIG. 7B, when there is no developer on the piezo element of the developer amount sensor SR2A, the system control device 11 determines that the amount of developer housed within the developer housing part 41B of the developing housing 41 is less than the predetermined value, and does not carry out rotation control (reverse rotation and high-speed forward rotation) for the supply auger 44. In this way, the powder level of the developer in the developer housing part 41B of the developing housing 41 can be reliably detected by the piezo element and the amount of developer can be stabilized.

Modified Example 2

Figure 8:
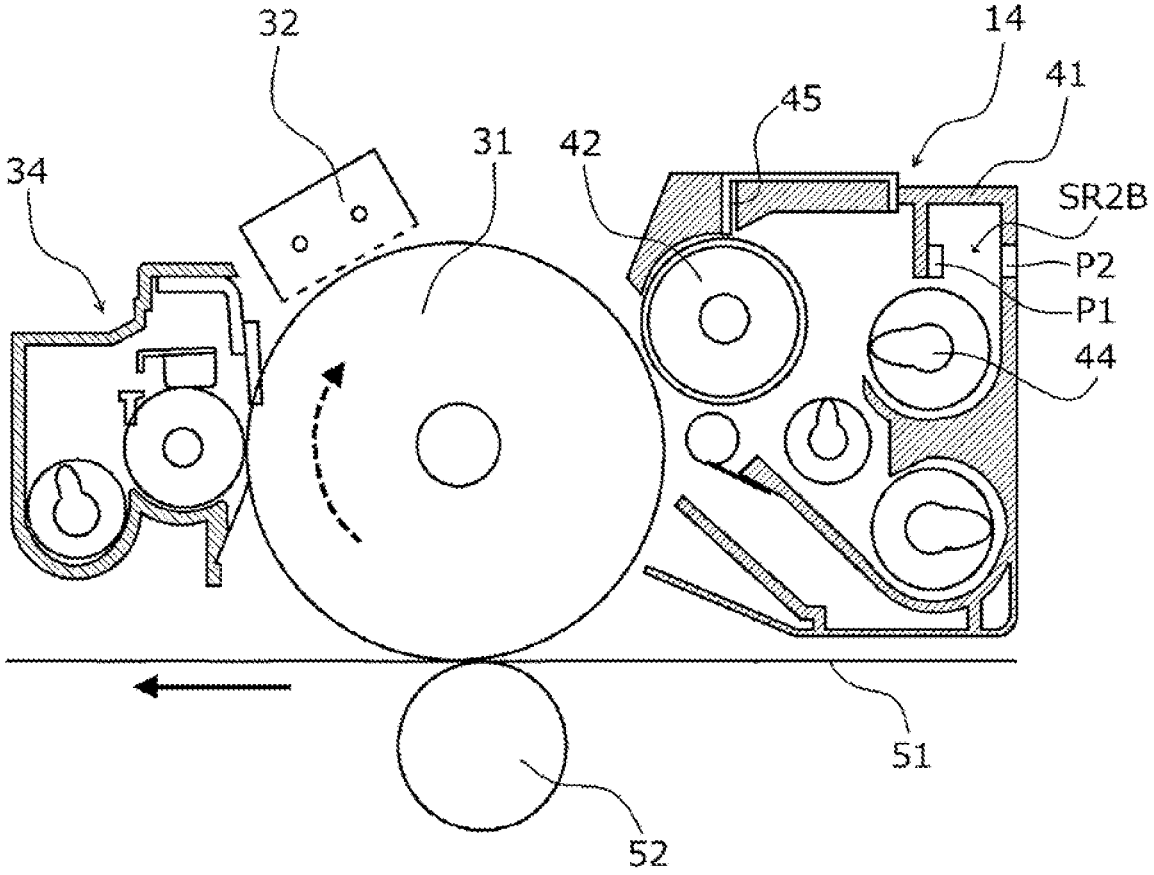
FIG. 8 is a cross-sectional schematic view of a developing device to which a developer amount sensor according to modified example 2 is attached.
Figure 9A:
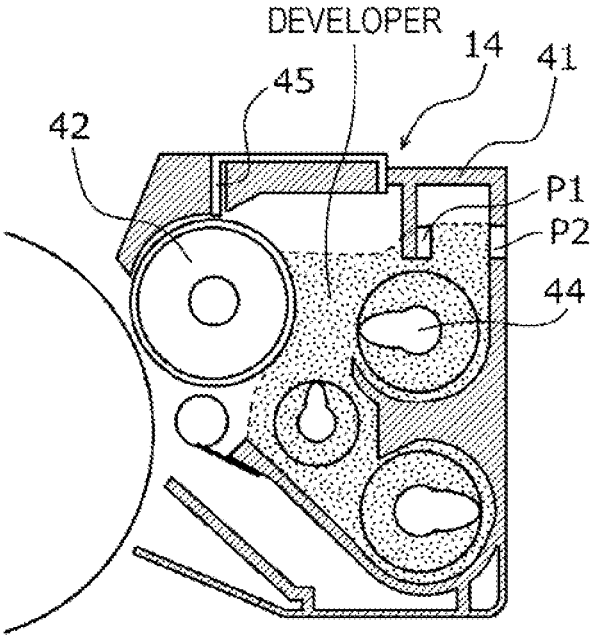
FIGS. 9A and 9B are cross-sectional schematic views of the developing device illustrating the detection of an amount of developer by the developer amount sensor according to modified example 2.
Figure 9B:
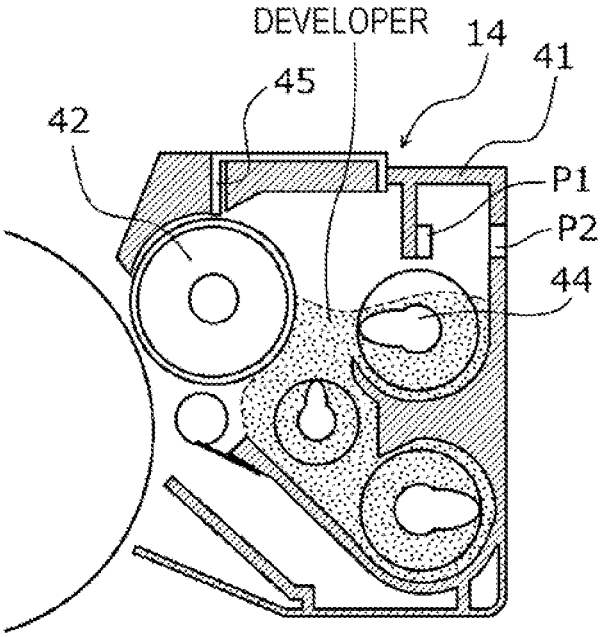

FIG. 8 is a cross-sectional schematic view of the developing device 14 to which a developer amount sensor SR2B according to modified example 2 is attached, and FIGS. 9A and 9B are cross-sectional schematic views of the developing device 14 illustrating the detection of an amount of developer by the developer amount sensor SR2B.

As depicted in FIG. 8, the developer amount sensor SR2B may be configured of electrodes P1 and P2 arranged opposing each other vertically above the supply auger 44 within the developer housing part 41B of the developing housing 41. The system control device 11 detects the powder level of the developer on the basis of changes in a current value measured with a voltage being applied between the electrodes P1 and P2.

As depicted in FIG. 9A, when there is developer between the electrodes P1 and P2 of the developer amount sensor SR2B, the system control device 11 determines that the amount of developer housed within the developer housing part 41B of the developing housing 41 is greater than or equal to a predetermined value, causes the supply auger 44 to reverse-rotate for the predetermined number of rotations N1 (S103), and then causes the supply auger 44 to forward-rotate for the predetermined number of rotations N2 at a faster rotation speed than normal (S104).

Meanwhile, as depicted in FIG. 9B, when there is no developer between the electrodes P1 and P2 of the developer amount sensor SR2B, the system control device 11 determines that the amount of developer housed within the developer housing part 41B of the developing housing 41 is less than the predetermined value, and does not carry out rotation control (reverse rotation and high-speed forward rotation) for the supply auger 44. In this way, by applying a voltage between the electrodes P1 and P2 arranged opposing each other vertically above the supply auger 44 and measuring the current that flows, the powder level of the developer in the developer housing part 41B of the developing housing 41 can be reliably detected and the amount of developer can be stabilized.

Modified Example 3

Figure 10:
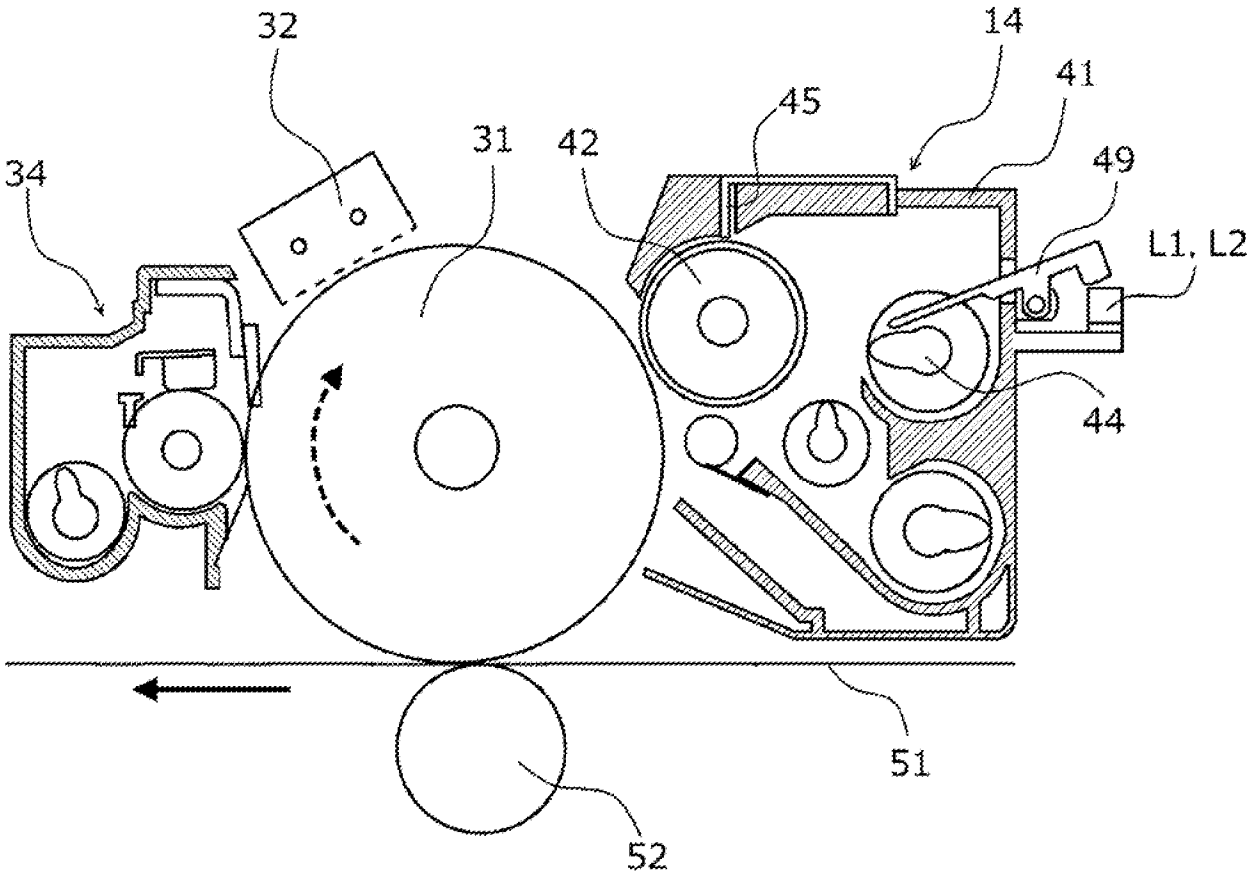
FIG. 10 is a cross-sectional schematic view of a developing device to which a developer amount sensor according to modified example 3 is attached.
Figure 11:
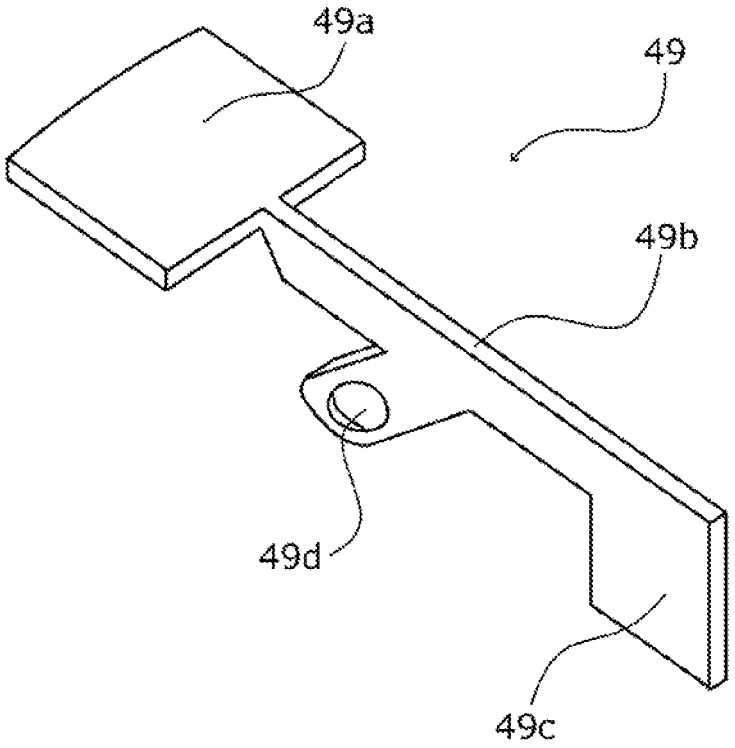
FIG. 11 is a perspective view depicting an actuator of the developer amount sensor according to modified example 3.
Figure 12A:
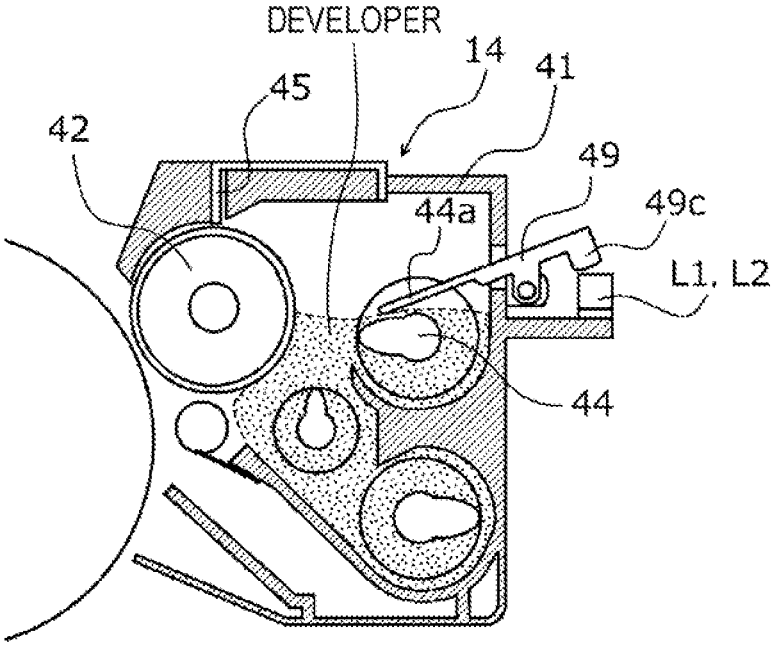
FIGS. 12A and 12B are cross-sectional schematic views of the developing device illustrating the detection of an amount of developer by the developer amount sensor according to modified example 3.
Figure 12B:
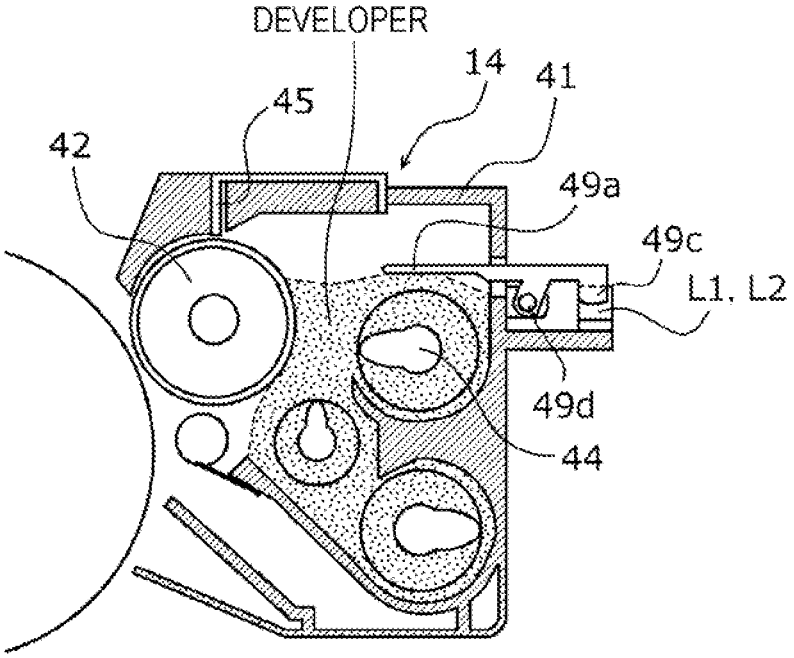

FIG. 10 is a cross-sectional schematic view of the developing device 14 to which a developer amount sensor SR2C according to modified example 3 is attached, FIG. 11 is a perspective view depicting an actuator of the developer amount sensor SR2C according to modified example 3, and FIGS. 12A and 12B are cross-sectional schematic views of the developing device 14 illustrating the detection of an amount of developer by the developer amount sensor SR2C.

The developer amount sensor SR2C according to modified example 3 has an actuator 49 that displaces when in contact with the powder level of the developer vertically above the supply auger 44. In a case where the powder level of the developer comes into contact with the actuator 49, the developer amount sensor SR2C detects the powder level of the developer due to light emitted from a light-emitting unit L1 arranged outside the developing housing 41 being received by a light-receiving unit L2 provided in a location opposite the light-emitting unit L1.

As depicted in FIGS. 9A and 9B, the actuator 49 is formed of a contact part 49*a* that comes into contact with the powder level of the developer, an arm part 49*b*, a detection part 49*c* that blocks light emitted from the light-emitting unit L1, and a rotation supporting point 49*d*, and is rotatably supported by a wall surface of the developing housing 41 at the rotation supporting point 49*d*.

In the developer amount sensor SR2C configured in this way, the contact part 49*a* does not come into contact with the developer and the detection part 49*c* does not block the light emitted from the light-emitting unit L1 in a case where the powder level of the developer in the developer housing part 41B of the developing housing 41 is low, as depicted in FIG. 12A.

However, when the powder level of the developer in the developer housing part 41B of the developing housing 41 becomes high and comes into contact with the contact part 49*a*, the actuator 49 rotates about the rotation supporting point 49*d* as the rotation center and the detection part 49*c* blocks light emitted from the light-emitting unit L1, as depicted in FIG. 12B.

As a result, the system control device 11 determines that the amount of developer housed within the developer housing part 41B of the developing housing 41 is greater than or equal to a predetermined value, causes the supply auger 44 to reverse-rotate for the predetermined number of rotations N1 (S103), and then causes the supply auger 44 to forward-rotate for the predetermined number of rotations N2 at a faster rotation speed than normal (S104). In this way, the powder level of the developer in the developer housing part 41B of the developing housing 41 can be reliably detected by the actuator 49 and the amount of developer can be stabilized.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A printer comprising:

a powder housing chamber that houses powder including a color material and carrier;

a supplying conveying unit that conveys the powder while supplying the powder to a powder holder that holds the powder, by forward rotation, the supply conveying unit being disposed adjacent to the powder holder;

a detection unit that detects an amount of the powder within the powder housing chamber, upstream in a conveyance direction from a discharge unit that discharges surplus powder, downstream in the conveyance direction from the supplying conveying unit, and above a rotary shaft of the supplying conveying unit; and a control unit that controls at least one of a rotation direction and a rotation speed of the supplying conveying unit on the basis of a detection result of the detection unit.

2. The printer according to claim 1, wherein, in a case where the amount of the powder exceeds a predetermined threshold value, the control unit causes the supplying conveying unit to perform a reverse rotation operation, and to then perform a forward rotation operation at a faster rotation speed than normal.

3. The printer according to claim 2, wherein, in a case where the amount of the powder is less than or equal to the predetermined threshold value, the control unit causes the supplying conveying unit to perform the reverse rotation operation and to then perform the forward rotation operation at the faster rotation speed than normal, and causes the supplying conveying unit to forward-rotate at a normal rotation speed.

4. The printer according to claim 1, wherein the detection unit detects a powder level of the powder by measuring a magnetic permeability of the powder.

5. The printer according to claim 2, wherein the detection unit detects a powder level of the powder by measuring a magnetic permeability of the powder.

6. The printer according to claim 3, wherein the detection unit detects a powder level of the powder by measuring a magnetic permeability of the powder.

7. The printer according to claim 1, wherein the detection unit has a piezo element arranged inside the powder housing chamber, and detects a powder level of the powder on the basis of whether or not the powder is present on the piezo element.

8. The printer according to claim 2, wherein the detection unit has a piezo element arranged inside the powder housing chamber, and detects a powder level of the powder on the basis of whether or not the powder is present on the piezo element.

9. The printer according to claim 3, wherein the detection unit has a piezo element arranged inside the powder housing chamber, and detects a powder level of the powder on the basis of whether or not the powder is present on the piezo element.

10. The printer according to claim 1, wherein the detection unit detects a powder level of the powder on the basis of a change in a current value measured with a voltage being applied between electrodes arranged opposing each other vertically above the supplying conveying unit.

11. The printer according to claim 2, wherein the detection unit detects a powder level of the powder on the basis of a change in a current value measured with a voltage being applied between electrodes arranged opposing each other vertically above the supplying conveying unit.

12. The printer according to claim 3, wherein the detection unit detects a powder level of the powder on the basis of a change in a current value measured with a voltage being applied between electrodes arranged opposing each other vertically above the supplying conveying unit.

13. The printer according to claim 1, wherein the detection unit has an actuator that displaces when in contact with a powder level of the powder vertically above the supplying conveying unit, and, in a case where the powder level of the powder comes into contact with the actuator, detects the powder level of the powder by light emitted from a light-emitting unit arranged outside the powder housing chamber being received by a light-receiving unit provided in a location opposite the light-emitting unit.

14. The printer according to claim 2, wherein the detection unit has an actuator that displaces when in contact with a powder level of the powder vertically above the supplying conveying unit, and, in a case where the powder level of the powder comes into contact with the actuator, detects the powder level of the powder by light emitted from a light-emitting unit arranged outside the powder housing chamber being received by a light-receiving unit provided in a location opposite the light-emitting unit.

15. The printer according to claim 3, wherein the detection unit has an actuator that displaces when in contact with a powder level of the powder vertically above the supplying conveying unit, and, in a case where the powder level of the powder comes into contact with the actuator, detects the powder level of the powder by light emitted from a light-emitting unit arranged outside the powder housing chamber being received by a light-receiving unit provided in a location opposite the light-emitting unit.

16. A printer comprising:

powder housing means for housing powder including a color material and carrier;

supplying conveying means for conveying the powder while supplying the powder to a powder holder that holds the powder, by forward rotation;

detection means for detecting an amount of the powder within the powder housing means, upstream in a conveyance direction from a discharge unit that discharges surplus powder, downstream in the conveyance direction from the supplying conveying means, and above a rotary shaft of the supplying conveying means; and control means for controlling at least one of a rotation direction and a rotation speed of the supplying conveying means on the basis of a detection result of the detection means.

* * * * *